US009399281B2

(12) United States Patent
Brendel et al.

(10) Patent No.: US 9,399,281 B2
(45) Date of Patent: Jul. 26, 2016

(54) STALL RELEASE LEVER FOR FASTENING TOOL

(71) Applicant: Black & Decker Inc., Newark, DE (US)

(72) Inventors: Lee Michael Brendel, Bel Air, MD (US); Paul G. Gross, White Marsh, MD (US); Michael P. Baron, Phoenix, MD (US)

(73) Assignee: BLACK & DECKER INC., New Britain, CT (US)

( * ) Notice: Subject to any disclaimer, the term of this patent is extended or adjusted under 35 U.S.C. 154(b) by 651 days.

(21) Appl. No.: 13/797,046

(22) Filed: Mar. 12, 2013

(65) Prior Publication Data

US 2014/0076951 A1 Mar. 20, 2014

Related U.S. Application Data

(60) Provisional application No. 61/703,463, filed on Sep. 20, 2012.

(51) Int. Cl.
*B25C 1/06* (2006.01)

(52) U.S. Cl.
CPC ..... *B25C 1/06* (2013.01)

(58) Field of Classification Search
CPC ..... B25C 1/06; B25C 1/00; B25C 5/10; B25C 5/06; B25C 5/00
USPC ..... 227/121, 8, 131
See application file for complete search history.

(56) References Cited

U.S. PATENT DOCUMENTS

| | | | |
|---|---|---|---|
| 1,945,892 | A | 2/1934 | Gobin |
| 2,069,042 | A | 1/1937 | Marchant |
| 2,593,715 | A | 4/1952 | Adler |
| 2,852,424 | A | 9/1958 | Reinhart |
| 3,305,156 | A | 2/1967 | Khan |
| 3,378,426 | A | 4/1968 | Medney |
| 3,500,940 | A | 3/1970 | Guest |
| 3,768,577 | A | 10/1973 | Leoni |
| 3,854,537 | A | 12/1974 | Nelmark et al. |
| 3,891,036 | A | 6/1975 | Schmidt |
| 3,930,297 | A | 1/1976 | Potucek et al. |
| 3,937,286 | A | 2/1976 | Wagner |
| 4,042,036 | A | 8/1977 | Smith et al. |
| 4,121,745 | A | 10/1978 | Smith et al. |
| 4,129,240 | A | 12/1978 | Geist |

(Continued)

FOREIGN PATENT DOCUMENTS

EP 2230050 A1 9/2010

*Primary Examiner* — Michelle Lopez

(74) *Attorney, Agent, or Firm* — Harness, Dickey & Pierce, P.L.C.

(57) ABSTRACT

A follower assembly includes a follower mounted on an axle with the axle being coupled to a carrier that is pivotable relative to the frame about a pivot axis. The follower assembly has a locked position in which the pivot axis and axle are positioned relative to each other in a locked over-center position. In the locked over-center position the driver is pinched between the follower assembly and the flywheel subjecting the driver to a pinch force when the driver is in the stall position. When the driver is in the stall position and the follower assembly is in the locked over-center position, pivotal movement of a stall release lever toward the release position forces the follower assembly out of the locked over-center position toward the reverse over-center position in which the relative positions of the pivot axis and axle are reversed and the pinch force is released.

20 Claims, 13 Drawing Sheets

(56) References Cited

U.S. PATENT DOCUMENTS

| | | | |
|---|---|---|---|
| 4,189,080 | A | 2/1980 | Smith et al. |
| 4,204,622 | A | 5/1980 | Smith et al. |
| 4,323,127 | A | 4/1982 | Cunningham |
| 4,434,121 | A | 2/1984 | Schaper |
| 4,473,217 | A | 9/1984 | Hashimoto |
| 4,519,535 | A | 5/1985 | Crutcher |
| 4,530,454 | A | 7/1985 | Gloor et al. |
| 4,544,090 | A | 10/1985 | Warman et al. |
| 4,558,747 | A | 12/1985 | Cunningham |
| 4,721,170 | A | 1/1988 | Rees |
| 4,724,992 | A | 2/1988 | Ohmori |
| 4,756,602 | A | 7/1988 | Southwell et al. |
| 4,773,633 | A | 9/1988 | Hinz et al. |
| 4,928,868 | A | 5/1990 | Kerrigan |
| 4,938,297 | A | 7/1990 | Schmidt |
| 4,964,558 | A | 10/1990 | Crutcher et al. |
| 5,069,379 | A | 12/1991 | Kerrigan |
| 5,088,566 | A | 2/1992 | Gustafsson et al. |
| 5,098,004 | A | 3/1992 | Kerrigan |
| 5,343,962 | A | 9/1994 | Daigle et al. |
| 5,445,227 | A | 8/1995 | Heppner |
| 5,511,715 | A | 4/1996 | Crutcher et al. |
| 5,802,691 | A | 9/1998 | Zoltaszek |
| 5,975,217 | A | 11/1999 | Frenzel et al. |
| 5,992,541 | A | 11/1999 | Frenzel et al. |
| 6,000,477 | A | 12/1999 | Campling et al. |
| 6,068,250 | A | 5/2000 | Hawkins et al. |
| 6,315,059 | B1 | 11/2001 | Geldean |
| 6,454,251 | B1 | 9/2002 | Fish |
| 6,607,111 | B2 | 8/2003 | Garvis et al. |
| 6,669,072 | B2 | 12/2003 | Burke et al. |
| 6,971,567 | B1 * | 12/2005 | Cannaliato ..... B25C 1/06 173/1 |
| 7,204,403 | B2 | 4/2007 | Kenney et al. |
| 7,503,401 | B2 | 3/2009 | Gross et al. |
| 7,556,184 | B2 | 7/2009 | Brendel et al. |
| 7,575,141 | B1 | 8/2009 | Liang et al. |
| 7,575,142 | B2 | 8/2009 | Liang et al. |
| 7,789,169 | B2 | 9/2010 | Berry et al. |
| 8,142,365 | B2 | 3/2012 | Miller |
| 8,302,833 | B2 | 11/2012 | Gross et al. |
| 2002/0003045 | A1 | 1/2002 | Bongers-Ambrosius |
| 2002/0108993 | A1 | 8/2002 | Harper et al. |
| 2002/0108994 | A1 | 8/2002 | Burke et al. |
| 2002/0108995 | A1 | 8/2002 | Hempfling et al. |
| 2005/0218177 | A1 | 10/2005 | Berry et al. |
| 2005/0218178 | A1 | 10/2005 | Berry et al. |
| 2005/0218182 | A1 | 10/2005 | Berry et al. |
| 2005/0218183 | A1 | 10/2005 | Berry et al. |
| 2007/0102471 | A1 | 5/2007 | Gross et al. |
| 2008/0048000 | A1 | 2/2008 | Simonelli et al. |
| 2009/0236387 | A1 | 9/2009 | Simonelli et al. |
| 2010/0187280 | A1 | 7/2010 | Akiba et al. |
| 2012/0097729 | A1 | 4/2012 | Gross et al. |

* cited by examiner

STALL RELEASE LEVER FOR FASTENING TOOL

CROSS-REFERENCE TO RELATED APPLICATIONS

This application claims the benefit of U.S. Provisional Application No. 61/703,463, filed on Sep. 20, 2012. The entire disclosure of the above application is incorporated herein by reference.

FIELD

The present disclosure relates to flywheel-driven fastening tools, and more particularly to providing such fastening tools with a stall release lever.

BACKGROUND

This section provides background information related to the present disclosure which is not necessarily prior art.

Flywheel-driven fastening tools, such as cordless framing nailers use a flywheel to drive a profile (or driver) in order to fire or propel nails. When a propelled nail strikes an object that is too hard or dense to penetrate, the driver can "stall" in the middle of the drive path.

In such a stalled position, the driver or profile is subjected to a pinch force between a pinch roller or follower and the flywheel. This pinch force can be quite large. For example, a 400-lb pinch force or greater can be exerted on the driver between the pinch roller and flywheel. When the profile stops in the middle of the drive (due to the lack of energy needed to drive the nail), the pinch force is still acting on the driver in the stalled position. This pinch force prevents the driver blade from returning to the start position without intervention. Typically, the user is forced to insert a long screw driver through the nosepiece of the tool and against the end of the driver and to manually push the blade back to the starting position. The pinch force continues to act on the driver until the driver moves to a position that is adjacent the start of the drive path.

SUMMARY

This section provides a general summary of the disclosure, and is not a comprehensive disclosure of its full scope or all of its features.

In one aspect of the present disclosure a flywheel-driven fastener driving tool is provided including a frame. A driver is movable along a driver path relative to the frame between a returned position and an extended position via a stall position. A motor is coupled to the frame and operably coupled to a flywheel to rotate the flywheel. A follower assembly is coupled to the frame and has a locked over-center position in which the driver is pinched between the follower assembly and the flywheel, subjecting the driver to a pinch force when the driver is in the stall position. The follower assembly also has a reverse over-center position. A stall release lever is pivotably coupled to the frame and has a home position allowing the follower assembly to be in the locked over-center position. The stall release lever also has a release position. When the driver is in the stall position and the follower assembly is in the locked over-center position, pivotal movement of the stall release lever toward the release position forces the follower assembly out of the locked over-center position toward the reverse over-center position in which the pinch force is released.

In another aspect of the present disclosure a flywheel-driven fastener driving tool is provided including a frame. A driver is movable along a driver path relative to the frame between a returned position and an extended position via a stall position. A motor is coupled to the frame and operably coupled to a flywheel to rotate the flywheel. A follower assembly is coupled to the frame. The follower assembly includes a follower mounted on an axle with the axle being coupled to a carrier that is pivotable relative to the frame about a pivot axis. The follower assembly has a locked position in which the pivot axis and axle are positioned relative to each other in a locked over-center position. In the locked over-center position the driver is pinched between the follower assembly and the flywheel subjecting the driver to a pinch force when the driver is in the stall position. The follower assembly also has a reverse over-center position. A stall release lever is pivotably coupled to the frame and has a home position allowing the follower assembly to be in the locked over-center position. The stall release lever also has a release position. When the driver is in the stall position and the follower assembly is in the locked over-center position, pivotal movement of the stall release lever toward the release position forces the follower assembly out of the locked over-center position toward the reverse over-center position in which the relative positions of the pivot axis and axle are reversed and the pinch force is released.

In yet another aspect of the present disclosure a flywheel-driven fastener driving tool is provided including a frame. A driver is movable along a driver path relative to the frame between a returned position and an extended position via a stall position. A motor is coupled to the frame and operably coupled to a flywheel to rotate the flywheel. A follower assembly is coupled to the frame. The follower assembly includes a follower mounted on an axle with the axle being coupled to a carrier that is pivotable relative to the frame about a pivot axis. The follower assembly has a locked position in which the pivot axis and axle are positioned relative to each other in a locked over-center position. In the locked over-center position the driver is pinched between the follower assembly and the flywheel subjecting the driver to a pinch force when the driver is in the stall position. The follower assembly also has a reverse over-center position. A stall release lever is pivotably coupled to the frame and has a home position allowing the follower assembly to be in the locked over-center position. The stall release lever also has a release position. When the driver is in the stall position and the follower assembly is in the locked over-center position, pivotal movement of the stall release lever toward the release position pushes the follower assembly out of the locked over-center position toward the reverse over-center position in which the relative positions of the pivot axis and axle are reversed and the pinch force is released.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
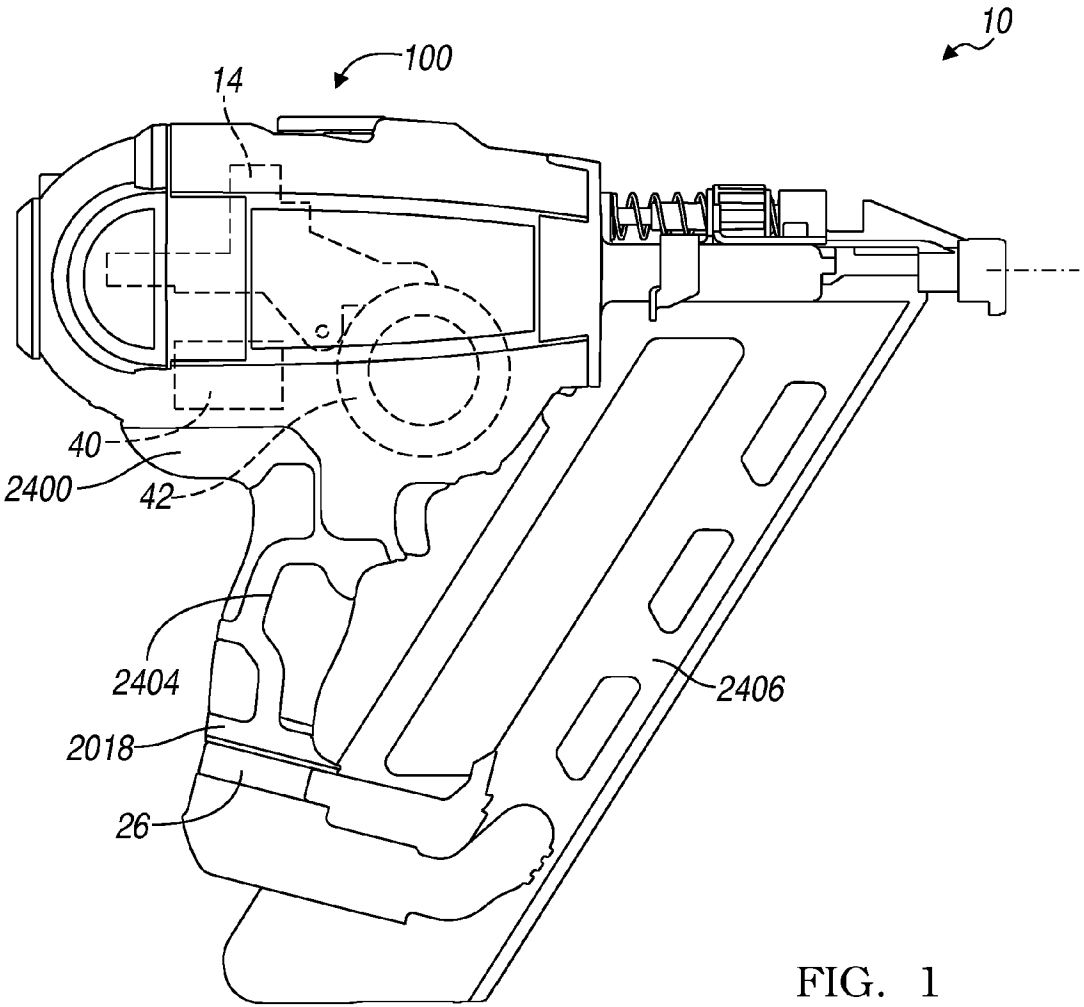
FIG. 1 is a side elevation view of an example of a fastening tool constructed in accordance with the teachings of the present disclosure.

Example embodiments will now be described more fully with reference to the accompanying drawings. While the fastening tool 10 is illustrated as being electrically powered by a suitable power source, such as the battery pack 26, those skilled in the art will appreciate that the invention, in its broader aspects, may be constructed somewhat differently and that aspects of the present invention may have applicability to pneumatically powered fastening tools. Furthermore, while aspects of the present invention are described herein and illustrated in the accompanying drawings in the context of a nailer, those of ordinary skill in the art will appreciate that the invention, in its broadest aspects, has further applicability.

With reference to FIG. 1-9, a driving tool 10 generally comprises a backbone or frame 14 supported within a housing 2400. Housing 2400 includes a magazine portion 2406 for positioning fasteners F in line with a driver 32. Housing 2400 also includes a handle portion 2404, and a mount 2418 for coupling a battery 26 to housing 2400. A stall release lever 100 can be manually accessible on the exterior of the housing assembly 12.

Coupled to the backbone or frame 14 are a motor 40 and a flywheel 42. The motor 40 is operably coupled to the flywheel 42 to rotate the flywheel 42. For example, the motor 40 can be an outer rotor brushless motor where the flywheel 42 is an integral part of the outer rotor. Alternatively, motor 40 can be drivingly coupled to flywheel 42 via a transmission (not shown). Also coupled to the frame 14 are an actuator 44 and a follower assembly 804 that can include a first arm 3000, a second arm 3004, and a carrier 3002.

The first arm 3000 can include a pair of arm members 3020 that can be spaced laterally apart and coupled together by a laterally extending member 3021, which can be formed integrally therewith. The first arm 3000 can be coupled to the backbone 14.

The carrier 3002 can include a pair of arm members 3050 coupled together by a laterally extending central member 3052, which can be formed integrally therewith. A first axle or pivot 3056 and a second axle 3058 extend between and are coupled to the pair of arm members 3050. The first axle 3056 can extend through the arm members 3050 and can be received in the pivot slots 3028 in the arm members 3020 of the first arm 3000. Accordingly, it will be appreciated that the carrier 3002 can be coupled to the first arm 3000 for rotation about the first axle or pivot 3056 and that the carrier 3002 can move relative to the first arm 3000 in a direction that can be dictated by the shape of the pivot slots 3028.

A first roller 3006 can be rotatably mounted on the first axle or pivot 3056. A second roller or follower 3008 can be rotatably mounted on the second axle 3058. A torsion spring 3060 can be mounted to the first arm 3000 and the carrier 3002 to bias the carrier 3002 toward an over-center position. When the carrier 3002 is in the over-center position, the centerline of the second axle 3058 is relatively closer to the front of the first arm 3000 (at the right in FIG. 4) than the centerline of the first axle 3056.

The second arm 3004 can include a pair of arm members 3072 coupled together by a laterally extending central member 3088, which can be formed integrally therewith. The second arm 3004 can include a first portion 3080. The second arm 3004 is coupled to biasing mechanism 3010 at the first portion 3080. At the opposite end of the first portion 3080, the second arm 3004 is coupled to the actuator 44 via axle or pin 3146 to guide and support the end of the plunger 3104 and of second arm 3004.

The actuator 44 can be an appropriate type of linear actuator. In the example provided, the actuator 44 is a solenoid that includes a body 3102, a plunger 3104, which is movable relative to the body 3102, and a plunger spring 3108 that biases the plunger 3104 into an extended position. While the plunger spring 3108 is illustrated as being received in the body 3102, it will be appreciated that in the alternative the plunger spring 3108 can be received about the plunger 3104 between a feature on the plunger 3104 and the plunger body 3102.

The biasing mechanism 3010 can include a first flanged member 3230 coupled to a second flanged member 3212 by a fastener 3240 to confine a spring 3210 against first portion 3080 of second arm 3004. A pair of trunnions 3238 can be coupled to the opposite sides of the first flanged member 3230 and can be received in the retainer apertures 3030 in the arm members 3020 of the first arm 3000. In the example provided, the retainer apertures 3030 are slots. The retainer apertures 3030 can cooperate with the trunnions 3238 to limit movement of the second arm 3004 along the axis of the spring 3210. The above described configuration is capable of exerting a large pinching force on the driver 32 as discussed hereinafter.

Figure 2:
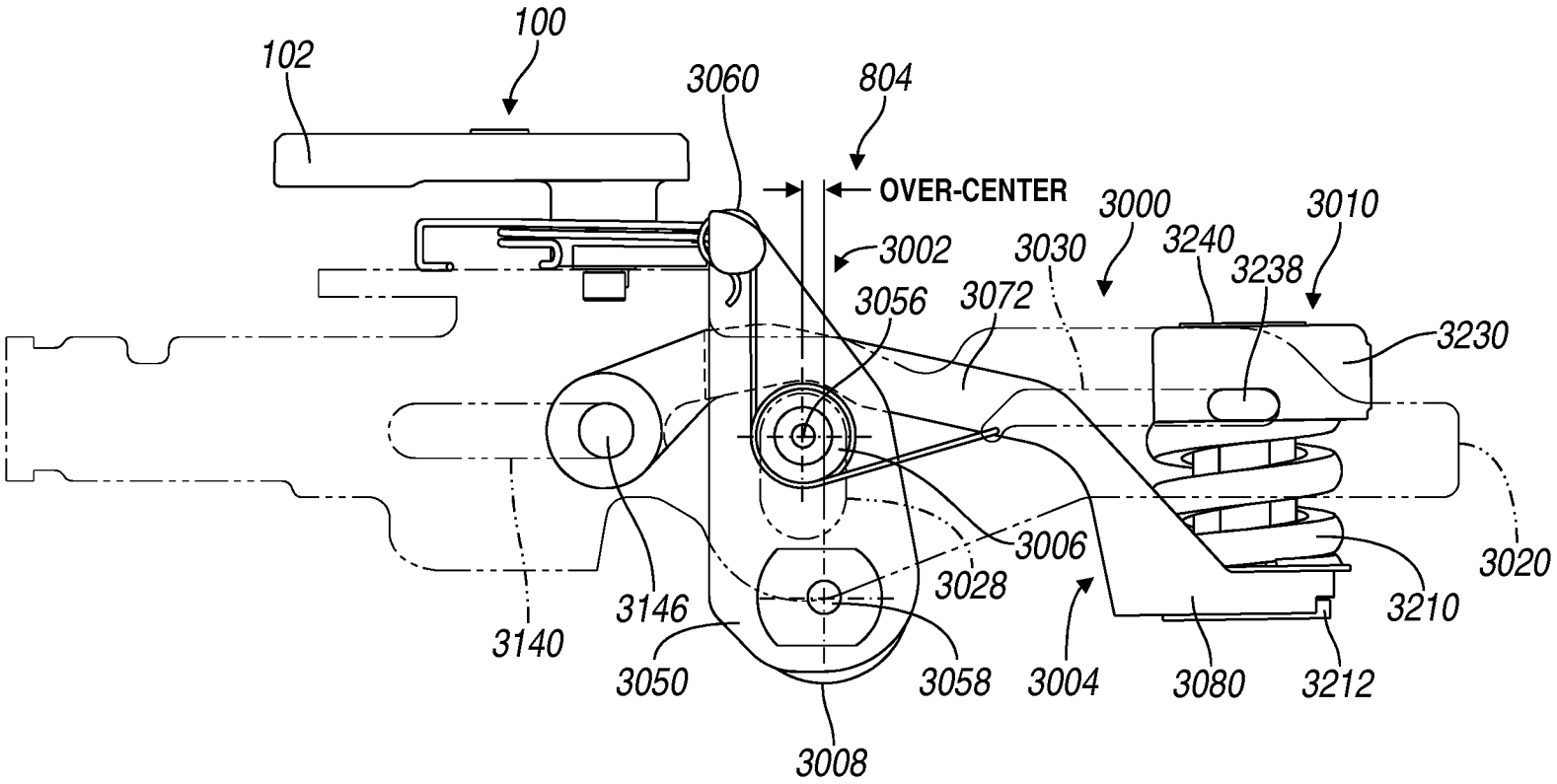
FIG. 2 is a side elevation view of various components of the tool of FIG. 1, showing the stall release lever in a home position.
Figure 3:
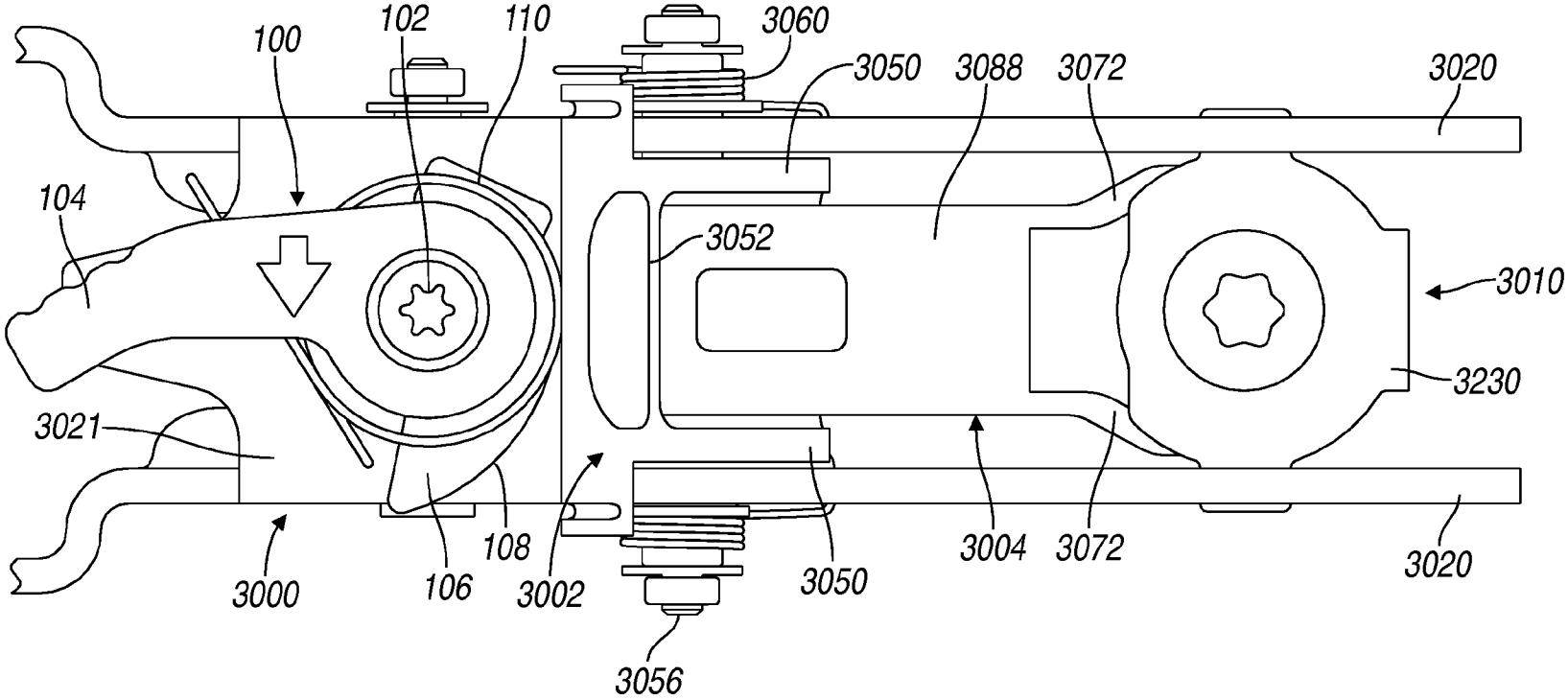
FIG. 3 is a top plan view of the components of FIG. 2.
Figure 4:
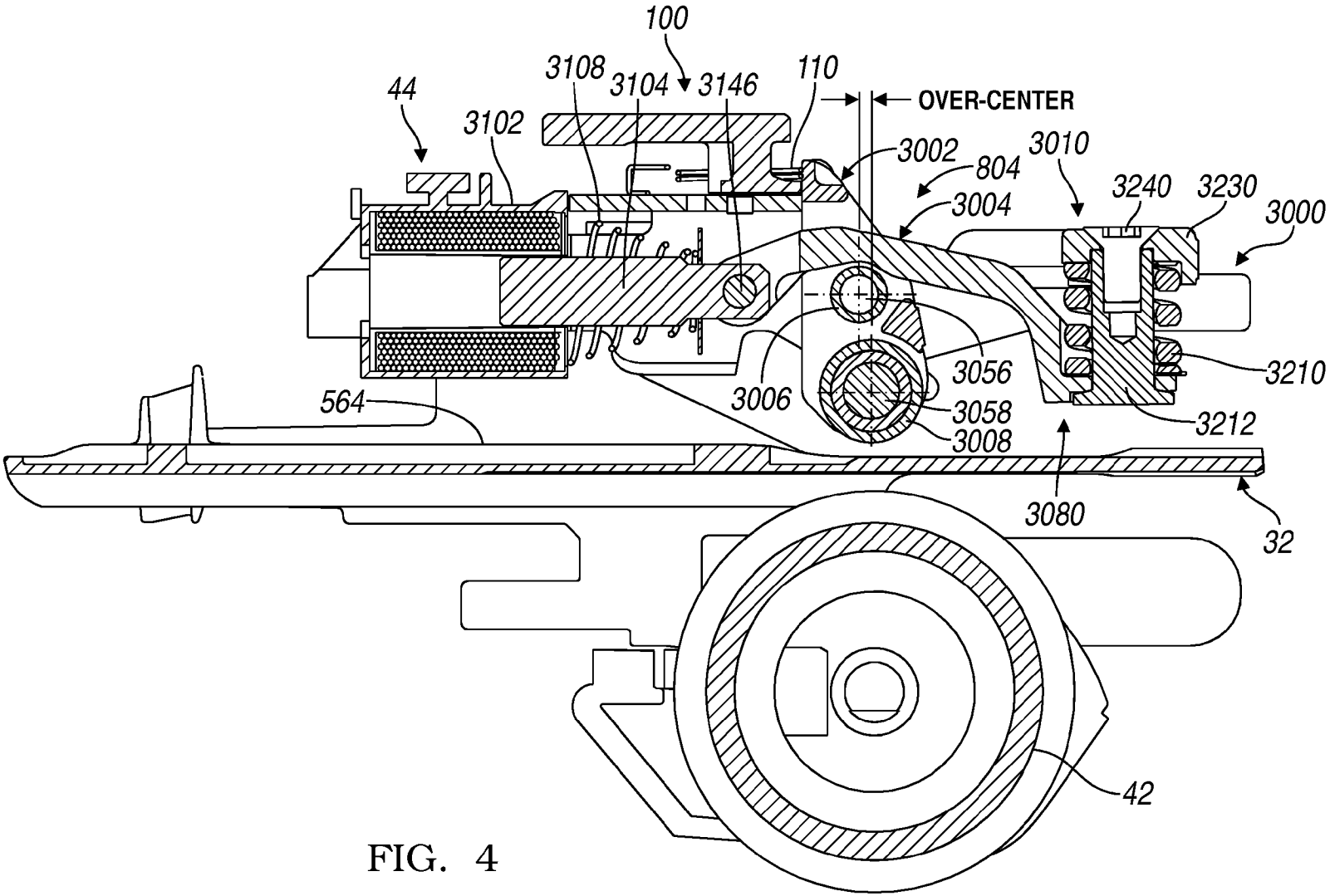
FIG. 4 is a partial cross-sectional view of the tool of FIG. 1, showing the follower assembly in its non-actuated state.

FIGS. 2-4 illustrate the tool 10 in a state prior to activation of the solenoid actuator 44. Each of the actuator 44, the arms 3000, 3004, carrier 3002, follower 3008, and driver 43 are all in their returned or home positions. It will be appreciated that the plunger 3104 of the actuator 44 is located in an extended position (i.e., to the right in the figure) and the carrier 3002 is biased about the first roller 3006 in a counter-clockwise direction by the spring 3060. In this over-center orientation of the carrier 3002 and its follower 3008, the axle 3058 of the follower 3008 is closer from the front of the tool (at the right in FIG. 2) than the pivot 3056 of the carrier 3002. Spring 3060 also biases carrier upwardly (as viewed in the figure) against second arm 3004, and away from the flywheel 42 and the driver 32. Thus, in the free over-center position follower 3008 is not pinching driver 32 against flywheel 42.

Figure 5:
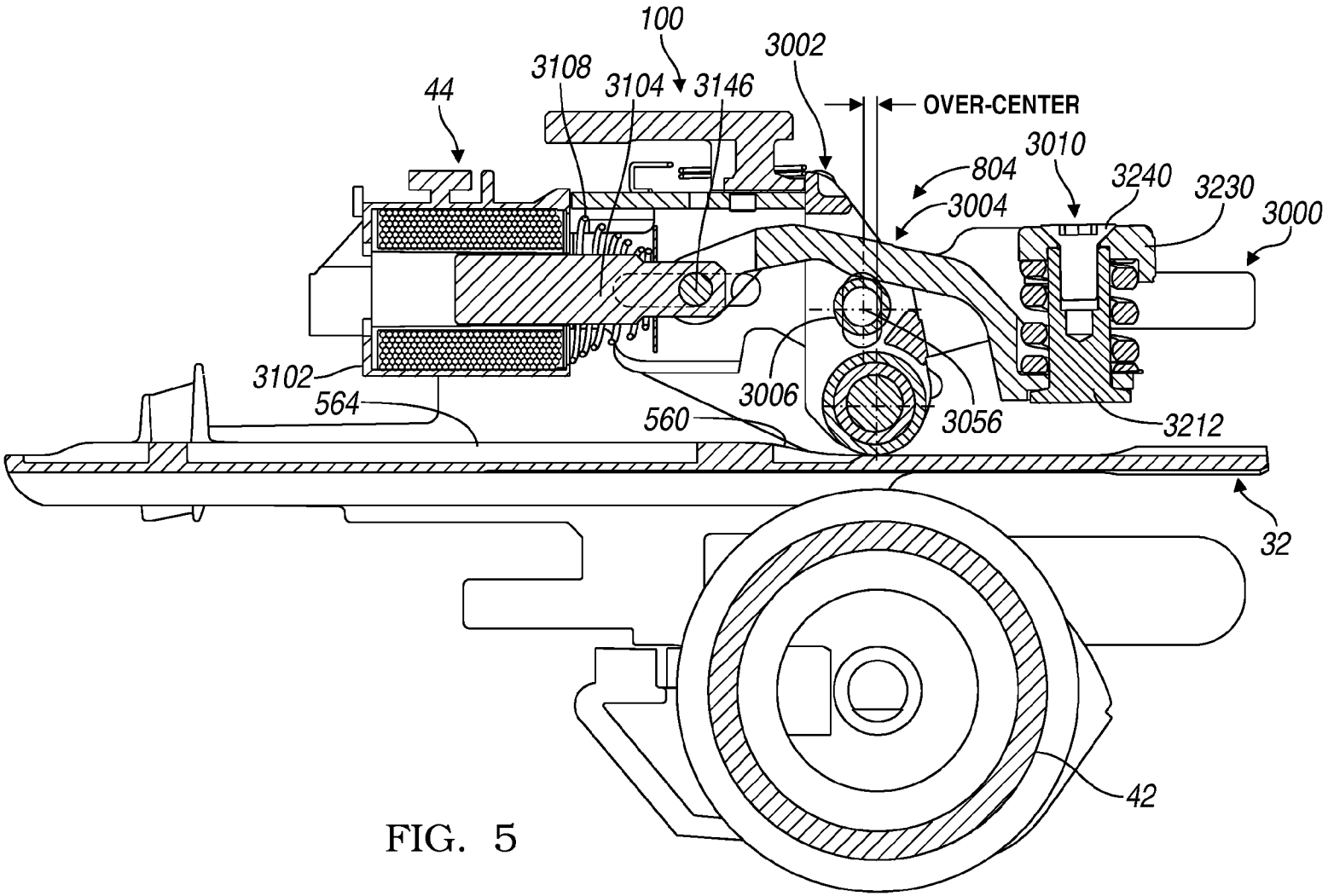
FIG. 5 is a partial cross-sectional view similar to FIG. 4, showing the follower assembly initially contacting the driver.

FIG. 5 illustrates the tool 10 in a condition in which the actuator 44 has been activated and the plunger 3104 is being pulled into the body 3102. Movement of the plunger 3104 in this direction can pull the second arm 3004 toward the body 3102, which can cause the second arm 3004 to act as a wedge against the first roller 3006 to drive the second arm 3002 toward the driver 32 (downwardly as viewed in FIG. 5). The torsion spring 3060 can maintain the carrier 3002 in the first predetermined over-center position. Contact between the second roller 3008 and the first cam portion 560 of the driver 32 can drive the driver 32 into driving engagement with the flywheel 42 wherein energy is transmitted from the flywheel 42 to the driver 32 to translate the driver 32 along the driver axis. It will be appreciated that the carrier 3002 can remain in the over-center position with the centerline of the follower axle 3058 relatively closer to the front of the tool (the right in FIG. 5) than the centerline of the first axle or 3056.

Figure 6:
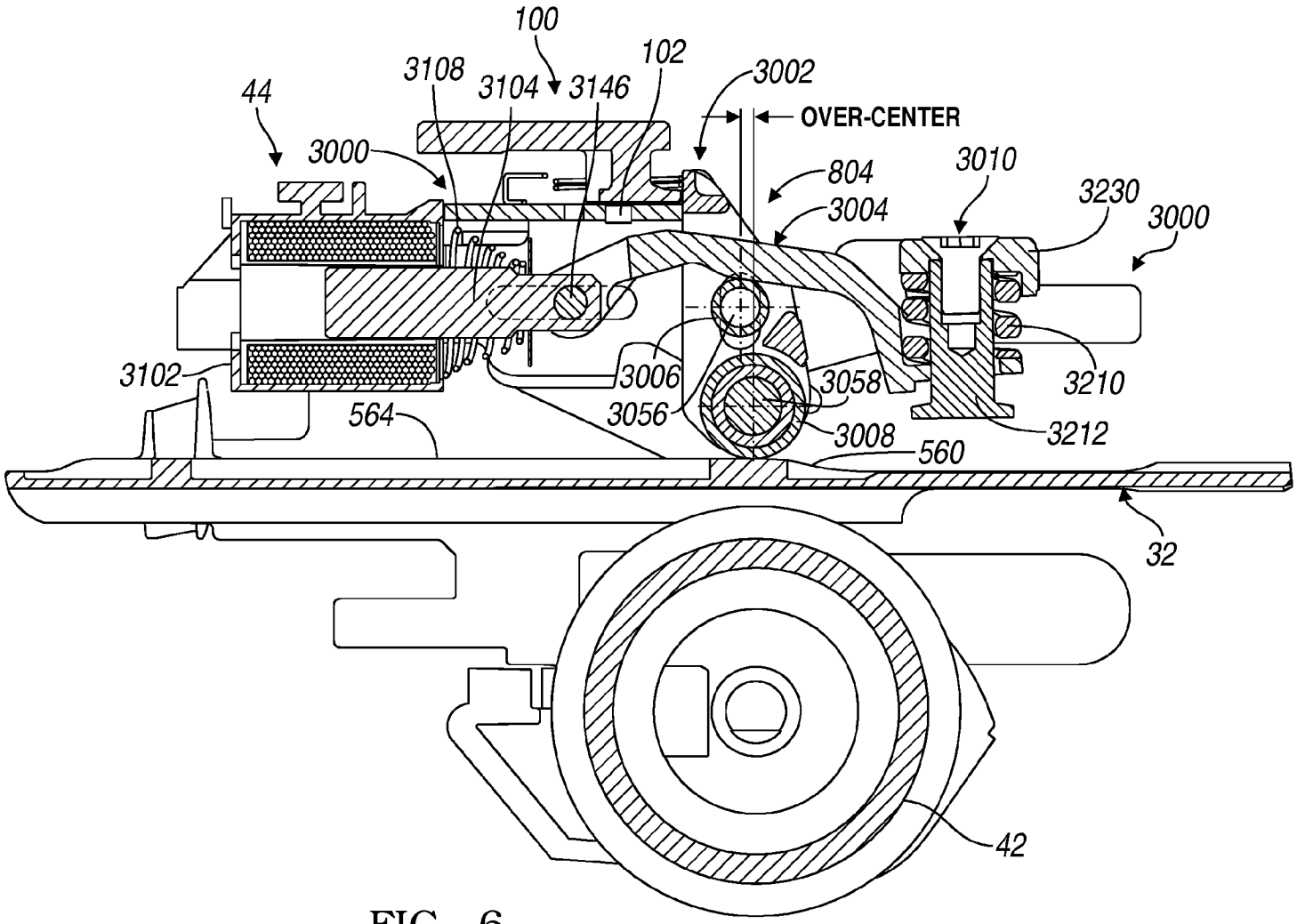
FIG. 6 is a partial cross-sectional view similar to FIG. 4, showing the follower assembly and driver in an intermediate or stalled state.

FIG. 6 illustrates the tool 10 in a condition in which the pinch roller or follower 3008 is transitioning from the first cam portion 560 to the rails 564. It will be appreciated that the first cam portion 560 is contoured (e.g., tapered) in a manner that can cause the follower 3008 and the carrier 3002 to travel away from the flywheel 42 as the driver 32 is being advanced to thereby load the spring 3210 of the biasing mechanism 3010. As will be appreciated by one of skill in the art from this disclosure, the location of the carrier 3002 pivots 3056 and follower axle 3058 in the over-center position permits the follower 3008 to be rotationally locked so as to produce a wedging effect involving the flywheel 42, the driver 32 and the follower assembly 804 to exert a force on the driver-flywheel interface that significantly exceeds the force that could be produced by the actuator 44 alone. Thus, the follower assembly 804, including carrier 3002 and follower 3008, is in a locked over-center position.

The tool 10 can become stalled with the follower assembly 804 in this locked over-center state as seen in FIG. 6. Thus, the tool 10 can become stalled with the driver 32 in an intermediate or stall position (e.g., FIG. 6) between the returned position (FIG. 4) and the extended position (further to the right in FIG. 6) of driver 32. In this state, a substantial pinching force is exerted on the driver 32 between the follower assembly 804 and the flywheel 42. In some cases, this pinching force can be about 400 pounds.

In the locked over-center position, the carrier 3002 is wedged against first arm member 3000 adjacent the stall release lever 100. The stall release lever 100 is pivotably coupled to the first arm 3000 via pivot member 102 and is thereby coupled to the backbone of frame 14. The stall release lever 100 includes a first lever arm 104 extending away from, or on a first side of the pivot member 102 and a second lever arm 106 extending away from, or on a second side of pivot member 102. The second lever arm 106 includes an arcuate or spiral-shaped ramped surface 108 configured to engage against an upper portion of the carrier 3002 of the follower assembly 804.

A spring 110 biases the stall release lever 100 into the home position, illustrated in FIG. 3. When the stall release lever 100 is in its home position, carrier 3002 of the follower assembly 804 is allowed to be in its over-center position, which becomes the locked over-center position when it is pinching driver 32 against flywheel (FIG. 5).

Figure 7:
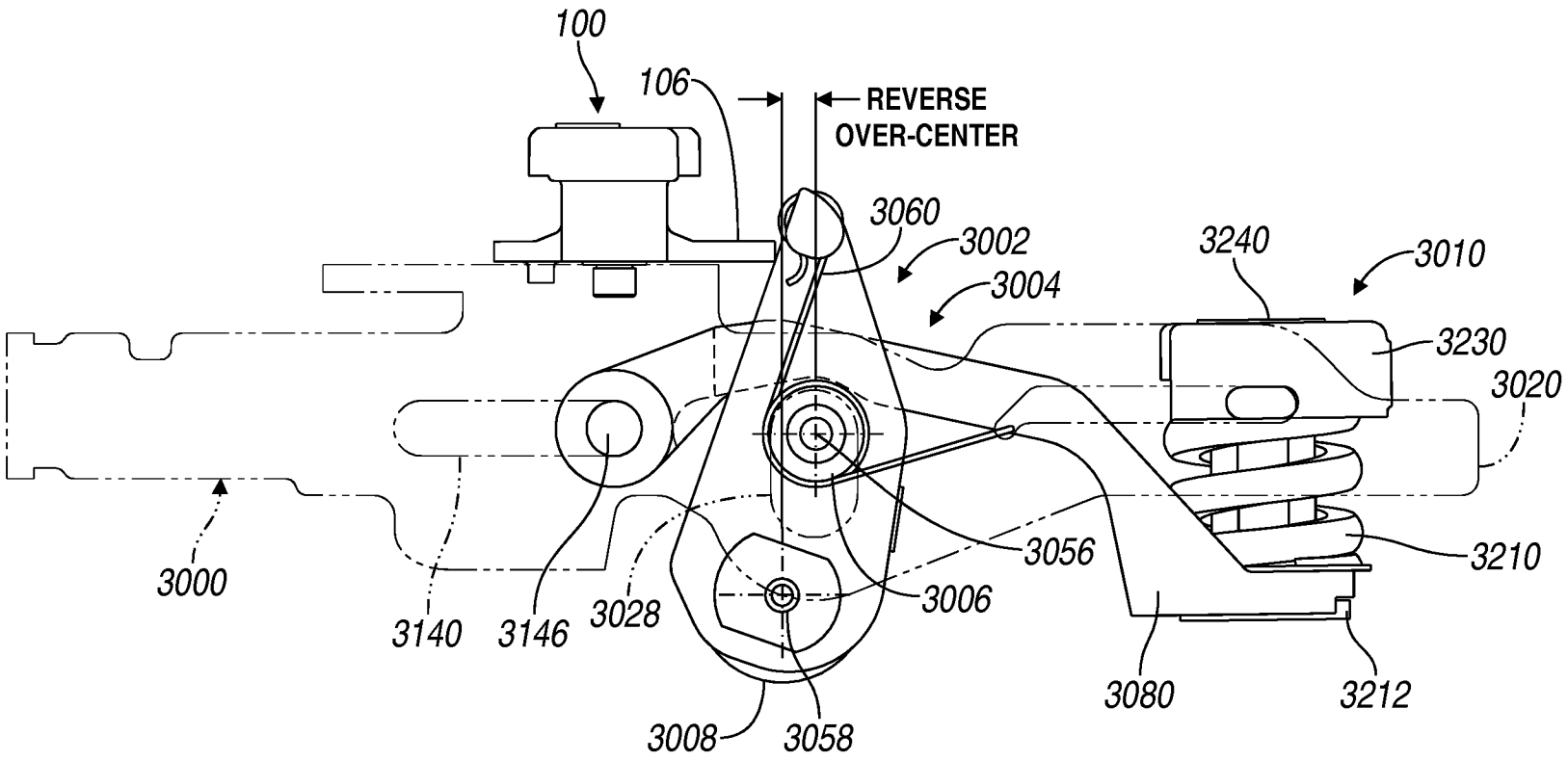
FIG. 7 is a side elevation view similar to FIG. 2, showing the stall release lever in a release position and the follower assembly in a reverse over-center position.
Figure 8:
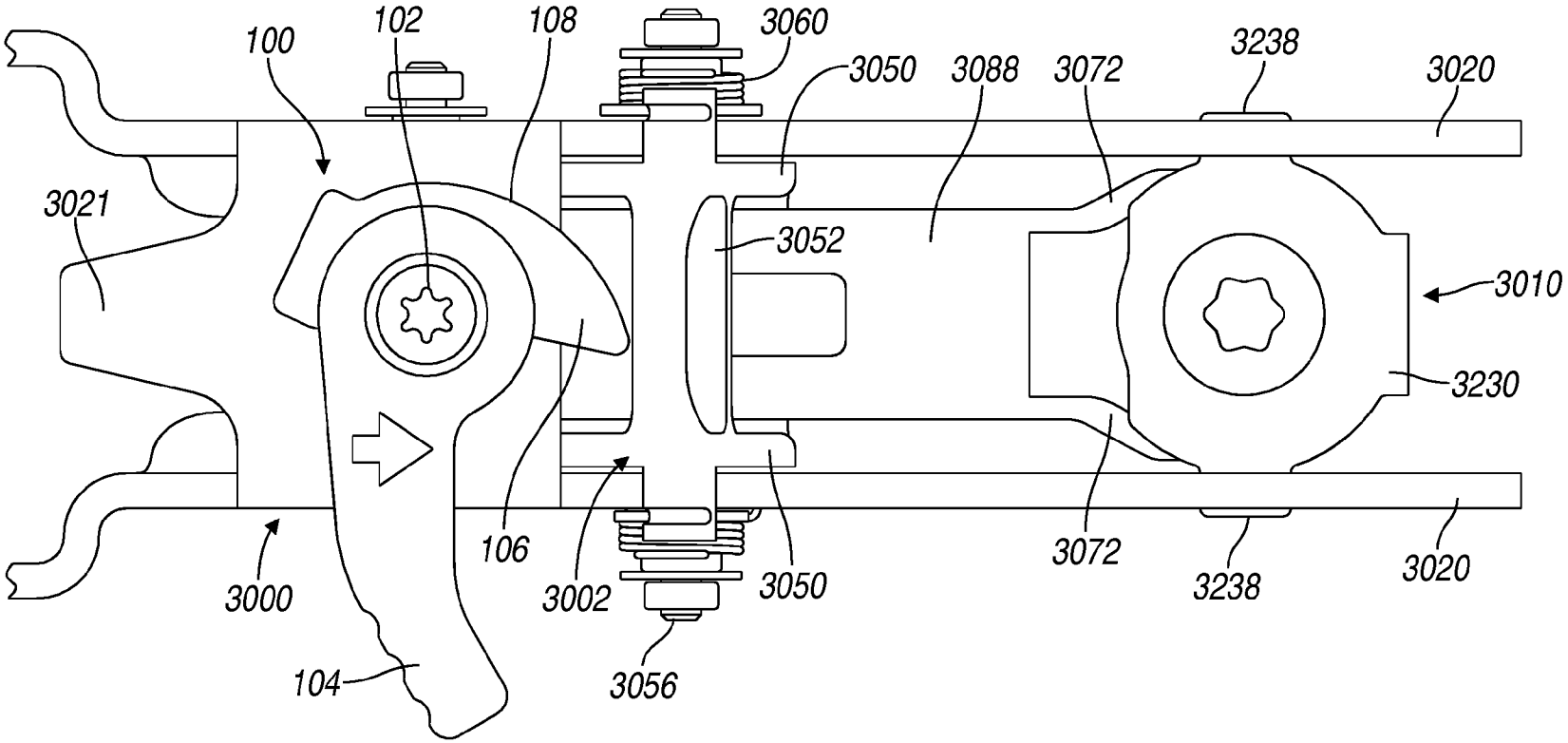
FIG. 8 is a top plan view of the components of FIG. 7.
Figure 9:
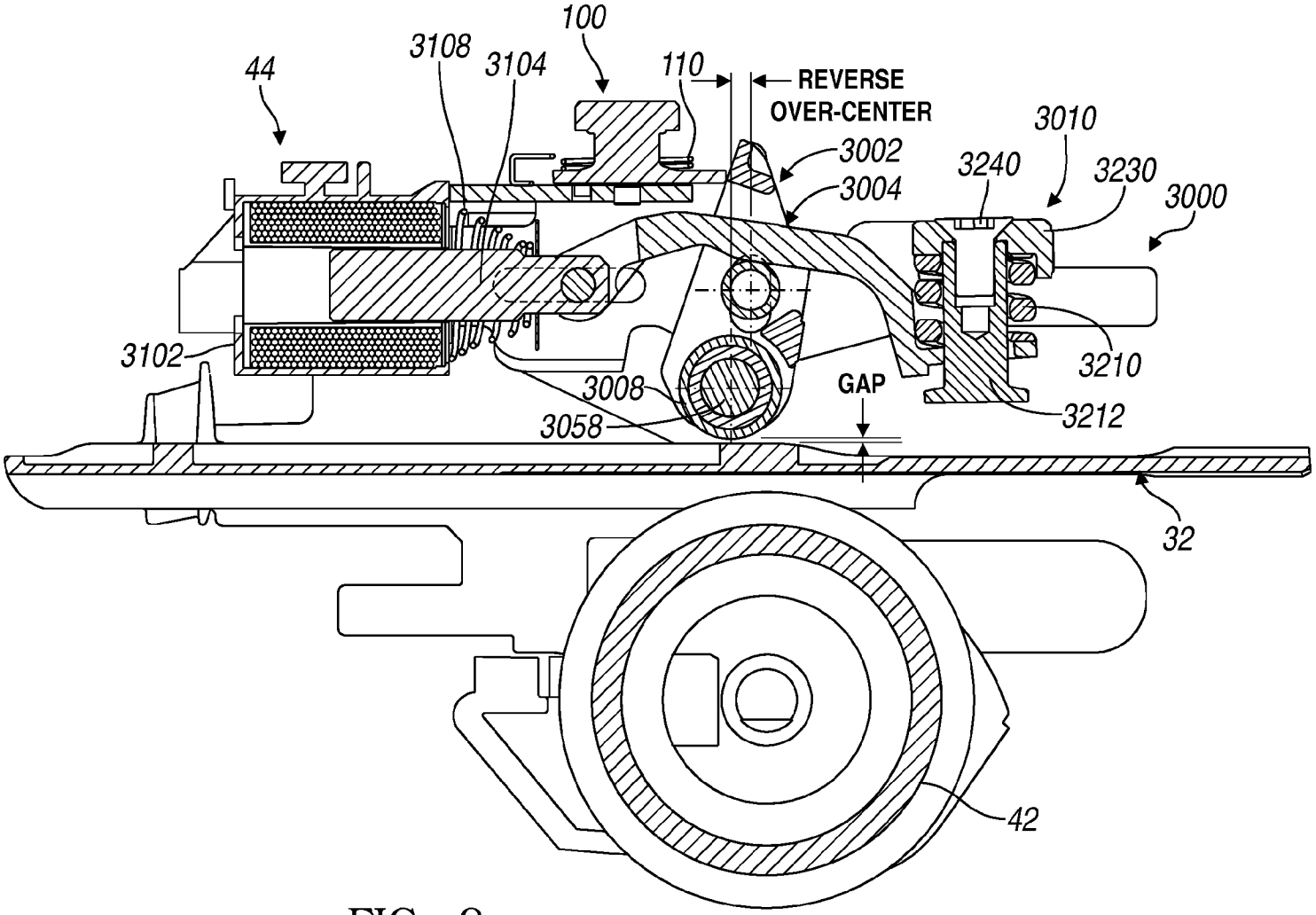
FIG. 9 is a partial cross-sectional view similar to FIG. 6, showing the stall release lever in a release position and follower assembly in a reverse over-center position.
Figure 10:
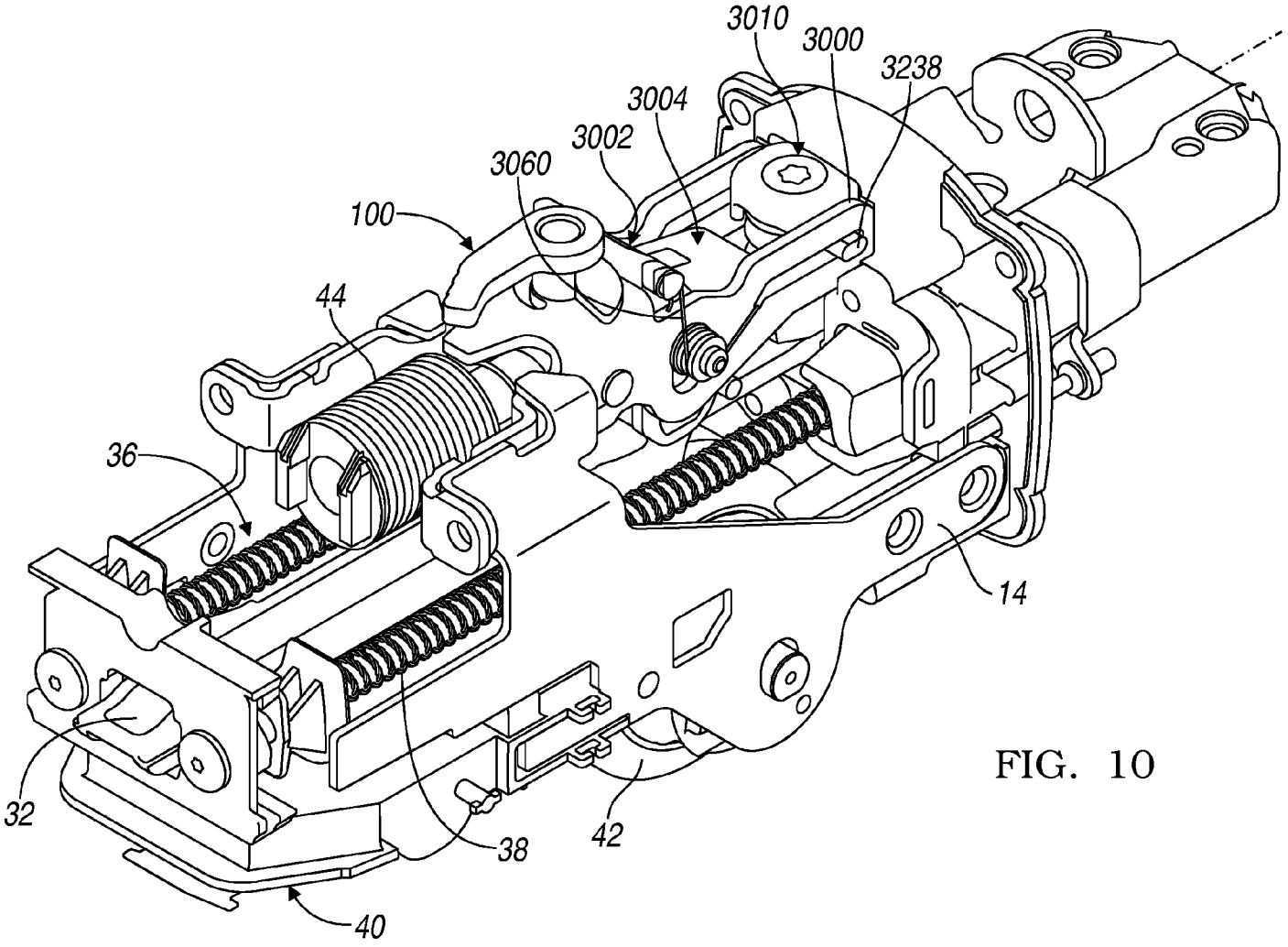
FIG. 10 is a perspective view of various components of the tool of FIG. 1.

When the follower assembly 804, including carrier 3002, is in the locked over-center position and the driver 32 is in a stall position, a user can rotate stall release lever 100 toward a release position illustrated in FIGS. 7-9. During rotation of the stall release lever 100, the spiral-shaped ramped surface 108 pushes against upper portion of the carrier 3002 of the follower assembly 804 causing the carrier 3002 to rotate about the pivot 3056 until the locked over-center is released. At this point, the carrier 3002 assumes a reversed over-center position where the axle 3058 of the pinch roller or follower 3008 moves to a position further from the front of the tool 10 (to the left in FIGS. 7-9) than pivot 3006 of carrier 3002.

Because the carrier 3002 is allowed to rotate in the reverse over-center direction away from the driver 32 and the flywheel 42, this frees driver to return to its returned position under the influence of the driver's return mechanism 36 which biases the driver 32 toward its returned position. One example return mechanism 36 can include compression return springs 38. Additional details regarding the return mechanism are disclosed in commonly assigned U.S. patent application Ser. No. 12/417,242 filed on Apr. 2, 2009, and U.S. patent application Ser. No. 13/796,648 filed Mar. 12, 2013, which are both hereby incorporated herein by reference in their entireties.

Figure 11:
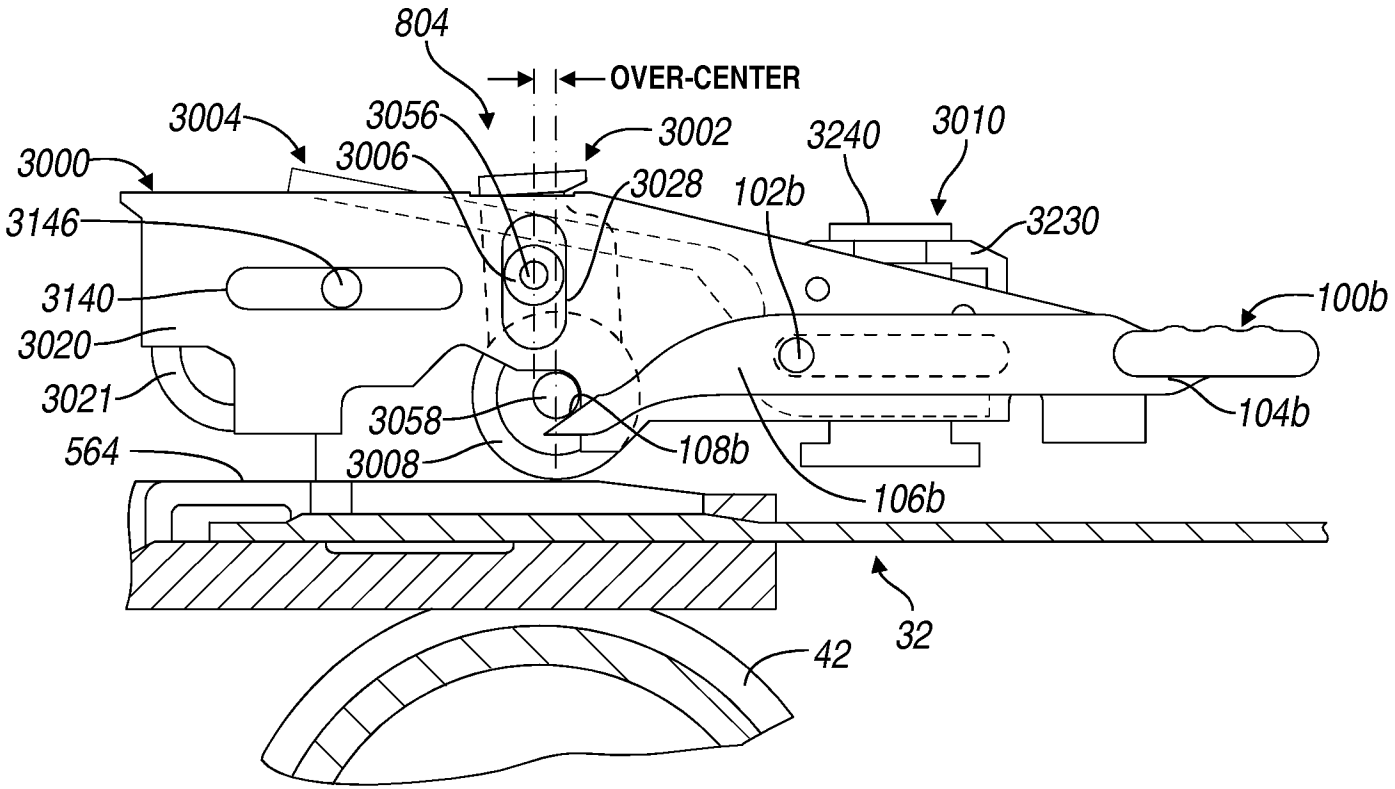
FIG. 11 is a partial cross-sectional side view of an alternative stall release mechanism constructed in accordance with the teachings of the present disclosure, showing the follower assembly and driver in an intermediate or stalled state.
Figure 12:
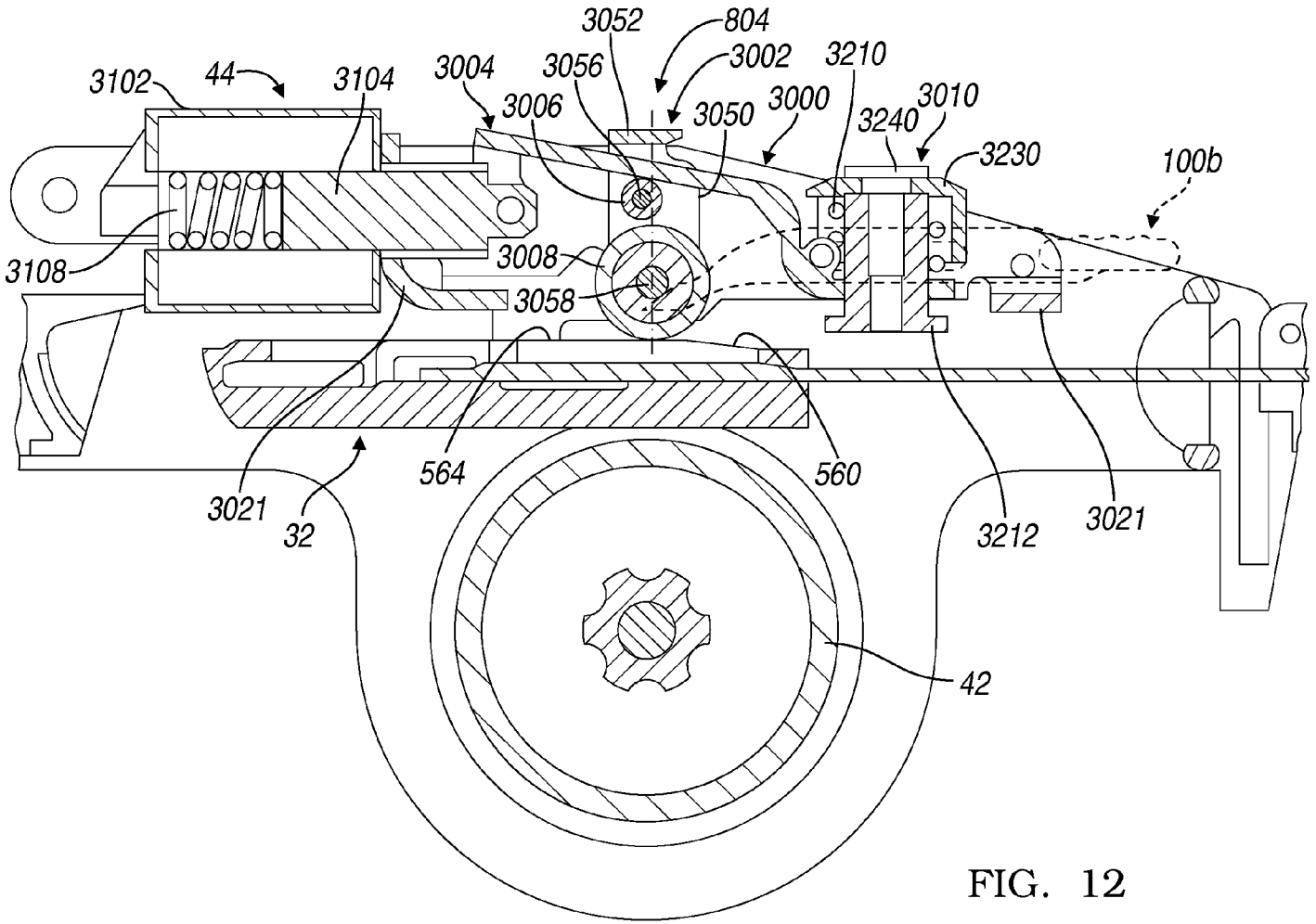
FIG. 12 is a cross-sectional view similar to FIG. 4, showing the follower assembly in a locked over-center position.
Figure 13:
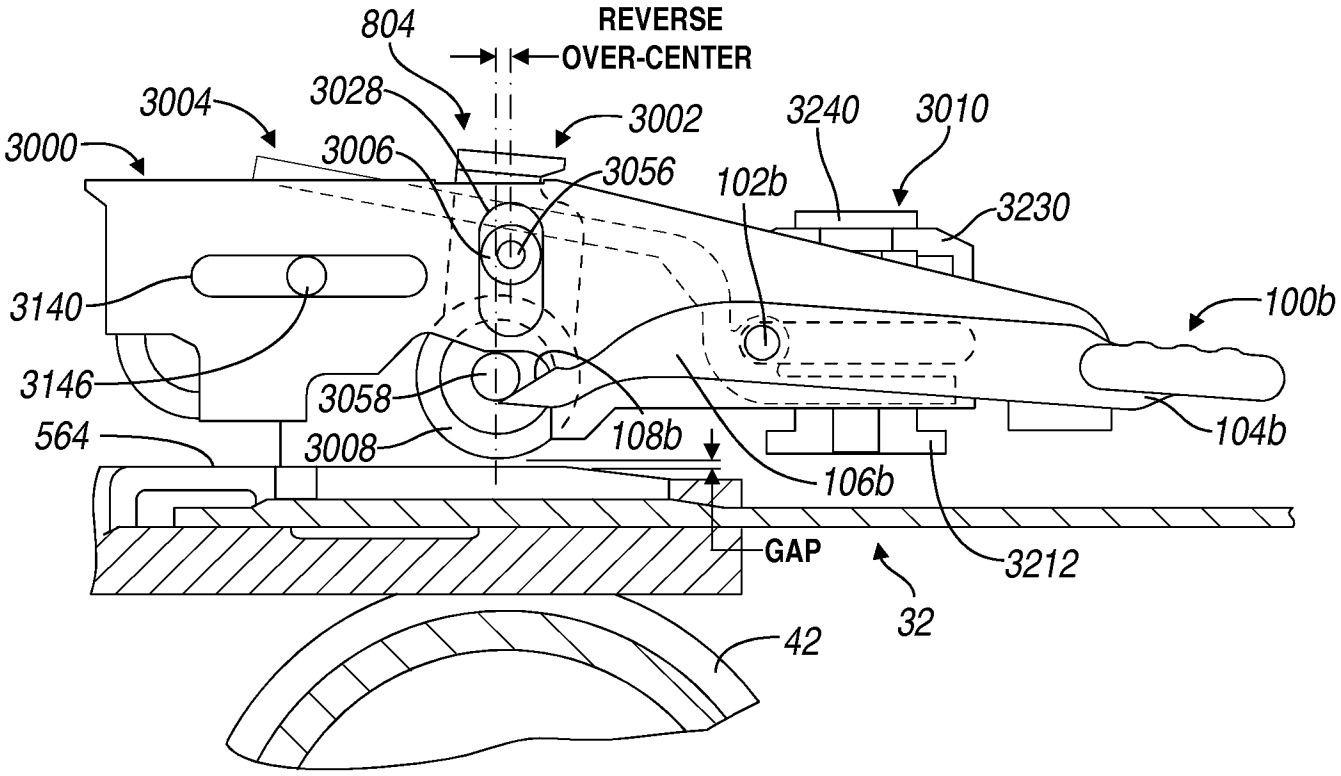
FIG. 13 is a partial cross-sectional view similar to FIG. 10, showing the follower assembly in a reverse over-center position.

Referring to FIGS. 11-13, another example of a stall release lever is provided. The various elements described herein that are generally similar in structure and function are identified by the same reference numbers as the prior embodiment. Additional details regarding the elements of this embodiment are described in commonly owned U.S. patent application Ser. No. 13/339,639 filed on Dec. 29, 2011, which is hereby incorporated herein in its entirety.

In this example, the carrier 3002 of the follower assembly 804 is wedged against the first arm 3000 via the axle 3058 of the follower 3008 in the locked over-center position of FIGS. 11 and 12. Thus, the first arm 3000 coupled to the frame 14 is engaged against the axle 3058, locking the follower assembly 804 in the over-center position to pinch the driver 32 against the flywheel 42. The follower axle 3058 extends outwardly beyond the first arm 3000.

During normal operation, the stall release lever **100*b* is biased into a home position, illustrated in FIGS. 11 and 12. In the home position, the stall release lever 100*b* allows the follower assembly 804 to be in the over-center position. The stall release lever 100*b* includes a first arm 104*b* extending in one direction, or on one side, of the pivot 102*b*, and a second arm 106*b* extending in an opposite direction, or on the opposite side, of the pivot 102*b*. A spring (not shown) can be provided to bias the stall release lever 100*b*** into the home position.

The driver 32 can become stalled in an intermediate position with the carrier 3002 of the follower assembly 804 in the locked over-center position of FIGS. 11 and 12. When this occurs, a user can rotate the stall release lever **100*b* about the pivot 102*b* by applying a force to the first arm 104*b*. As the stall release lever 100*b* rotates, the angled surface 108*b* engages the follower axle 3058 to move the follower assembly 804 into the reverse over-center position illustrated in FIG. 13. The ramped surface 108*b* is illustrated as having a concave shape. Alternatively, the ramped surface 108*b*** could have a straight or angled shape.

As noted above, the pinch force between the follower 3008 and the flywheel can be about 400 pounds. The amount of direct force on the follower axle 3058 to move it from the locked over-center position to the reversed over-center position can be about 20 pounds. The stall release lever **100*b* provides a mechanical advantage that enables the 20 pounds necessary to roll the follower or pinch roller 3008** backwards with only 5-lbs of actuation force from the user.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description.

What is claimed is:

1. A flywheel-driven fastener driving tool comprising:

a frame;

a driver movable along a driver path relative to the frame between a returned position and an extended position through a stall position intermediate the returned and extended positions;

a motor coupled to the frame and operably coupled to a flywheel to rotate the flywheel;

a follower assembly coupled to the frame and having a locked over-center position in which the driver is pinched between the follower assembly and the flywheel subjecting the driver to a pinch force when the driver is in the stall position, and the follower assembly having a reverse over-center position;

a stall release lever pivotably coupled to the frame and having a home position allowing the follower assembly to be in the locked over-center position, and the stall release lever having a release position;

wherein, when the driver is in the stall position and the follower assembly is in the locked over-center position, pivotal movement of the stall release lever toward the release position forces the follower assembly out of the locked over-center position toward the reverse over-center position in which the pinch force is released.

2. The flywheel-driven fastener driving tool of claim 1, wherein the stall release lever comprises a ramped surface to force the follower out of the locked over-center position.

3. The flywheel-driven fastener driving tool of claim 2, wherein the ramped surface comprises a spiral shape.

4. The flywheel-driven fastener driving tool of claim 1, further comprising a lever biasing member biasing the stall release lever into the home position.

5. The flywheel-driven fastener driving tool of claim 1, wherein the follower assembly comprises a carrier and the stall release lever operably engages the carrier to force the follower assembly out of the locked over-center position.

6. The flywheel-driven fastener driving tool of claim 1, wherein the follower assembly comprises a follower mounted on an axle and the stall release lever operably engages the axle to force the follower assembly out of the locked over-center position.

7. The flywheel-driven fastener driving tool of claim 1, wherein, when the driver in the stall position, the pinch force is at least about 50 times the force required to pivot the stall release lever into the release position.

8. The flywheel-driven fastener driving tool of claim 1, wherein the stall release mechanism comprises a ramped surface to force the follower out of the locked over-center position.

9. The flywheel-driven fastener driving tool of claim 8, wherein the ramped surface comprises a spiral shape.

10. A flywheel-driven fastener driving tool comprising:

a frame;

a driver movable along a driver path relative to the frame between a returned position and an extended position through a stall position intermediate the returned and extended positions;

a motor coupled to the frame and operably coupled to a flywheel to rotate the flywheel;

a follower assembly coupled to the frame, the follower assembly comprising a follower mounted on an axle with the axle being coupled to a carrier that is pivotable relative to the frame about a pivot axis, the follower assembly having a locked position in which the pivot axis and axle are positioned relative to each other in a locked over-center position, in the locked over-center position the driver is pinched between the follower and the flywheel subjecting the driver to a pinch force when the driver is in the stall position, and the follower assembly having a reverse over-center position;

a stall release mechanism movably coupled to the frame and having a home position allowing the follower assembly to be in the locked over-center position, and the stall release mechanism having a release position;

wherein, when the driver is in the stall position and the follower assembly is in the locked over-center position, movement of the stall release mechanism toward the release position forces the follower assembly out of the locked over-center position toward the reverse over-center position in which the relative positions of the pivot axis and axle are reversed and the pinch force is released.

11. The flywheel-driven fastener driving tool of claim 10, further comprising a biasing member biasing the stall release mechanism into the home position.

12. The flywheel-driven fastener driving tool of claim 10, wherein the follower axle is coupled to the carrier on one side of the pivot and the stall release mechanism operably engages the carrier on a second side of the pivot to force the follower assembly out of the locked over-center position.

13. The flywheel-driven fastener driving tool of claim 10, wherein the stall release mechanism operably engages the axle to force the follower assembly out of the locked over-center position.

14. The flywheel-driven fastener driving tool of claim 10, wherein, when the driver in the stall position, the pinch force is at least about 50 times the force required to move the stall release mechanism into the release position.

15. A flywheel-driven fastener driving tool comprising:

a frame;

a driver movable along a driver path relative to the frame between a returned position and an extended position through a stall position intermediate the returned and extended positions;

a motor coupled to the frame and operably coupled to a flywheel to rotate the flywheel;

a follower assembly coupled to the frame, the follower assembly comprising a follower mounted on an axle with the axle being coupled to a carrier that is pivotable relative to the frame about a pivot axis, the follower assembly having a locked position in which the pivot axis and axle are positioned relative to each other in a locked over-center position, in the locked over-center position the driver is pinched between the follower and the flywheel subjecting the driver to a pinch force when the driver is in the stall position, and the follower assembly having a reverse over-center position;

a stall release lever pivotably coupled to the frame and having a home position allowing the follower assembly to be in the locked over-center position, and the stall release lever having a release position;

wherein, when the driver is in the stall position and the follower assembly is in the locked over-center position, pivotal movement of the stall release lever toward the release position pushes the follower assembly out of the locked over-center position toward the reverse over-center position in which the relative positions of the pivot axis and axle are reversed and the pinch force is released.

16. The flywheel-driven fastener driving tool of claim 15, wherein the stall release lever comprises a ramped surface to push the follower out of the locked over-center position.

17. The flywheel-driven fastener driving tool of claim 16, wherein the ramped surface comprises a spiral shape.

18. The flywheel-driven fastener driving tool of claim 17, wherein the follower axle is coupled to the carrier on one side of the pivot and the stall release lever pushes against the carrier on a second side of the pivot to push the follower assembly out of the locked over-center position.

19. The flywheel-driven fastener driving tool of claim 18, further comprising a lever biasing member biasing the stall release lever into the home position.

20. The flywheel-driven fastener driving tool of claim 16, wherein the stall release lever pushes against the axle to push the follower assembly out of the locked over-center position and further comprising a lever biasing member biasing the stall release lever into the home position.

* * * * *